US008400326B2

(12) United States Patent
Codazzi

(10) Patent No.: US 8,400,326 B2
(45) Date of Patent: Mar. 19, 2013

(54) INSTRUMENTATION OF APPRAISAL WELL FOR TELEMETRY

(75) Inventor: Daniel Codazzi, Gif sur Yvette (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 816 days.

(21) Appl. No.: 12/507,217

(22) Filed: Jul. 22, 2009

(65) Prior Publication Data

US 2011/0017512 A1 Jan. 27, 2011

(51) Int. Cl.
*G01V 3/00* (2006.01)

(52) U.S. Cl. ..... 340/853.1; 340/853.3; 340/854.7; 340/854.6

(58) Field of Classification Search ..... 340/854.7, 340/853.1, 855.1, 853.3, 854.3, 854.6; 398/113; 250/254

See application file for complete search history.

(56) References Cited

U.S. PATENT DOCUMENTS

| | | | | |
|---|---|---|---|---|
| 3,309,656 | A | 3/1967 | Godbey | |
| 5,642,051 | A | 6/1997 | Babour et al. | |
| 6,160,492 | A * | 12/2000 | Herman | 340/854.6 |
| 6,626,253 | B2 | 9/2003 | Hahn et al. | |
| 6,899,178 | B2 * | 5/2005 | Tubel | 166/313 |
| 7,080,699 | B2 | 7/2006 | Lovell et al. | |
| 7,249,636 | B2 * | 7/2007 | Ohmer | 166/383 |
| 7,477,161 | B2 * | 1/2009 | Macpherson et al. | 340/853.3 |
| 7,573,397 | B2 * | 8/2009 | Petrovic et al. | 340/854.6 |
| 2005/0126777 | A1 * | 6/2005 | Rolovic et al. | 166/255.1 |
| 2006/0290528 | A1 * | 12/2006 | MacPherson et al. | 340/853.1 |
| 2009/0120689 | A1 * | 5/2009 | Zaeper et al. | 175/40 |
| 2010/0013663 | A1 * | 1/2010 | Cavender et al. | 340/854.3 |

* cited by examiner

*Primary Examiner* — Jean B Jeanglaude
(74) *Attorney, Agent, or Firm* — Darla Fonseca

(57) ABSTRACT

A telemetry system for use in developing a field of wells has a first downhole device capable of transmitting and/or receiving signals disposed in an appraisal well, an electronics control system located at or near the top of the appraisal, a cable disposed in the appraisal well that provides signal communication between the first downhole device and the electronics control system, and a second downhole device capable of transmitting and/or receiving signals disposed in a second wellbore. The signal is passed through the cable between the first downhole device and the electronics control system. From there, the signal may be re-transmitted to a desired location.

26 Claims, 2 Drawing Sheets

INSTRUMENTATION OF APPRAISAL WELL FOR TELEMETRY

CROSS-REFERENCE TO OTHER APPLICATIONS

Not applicable.

BACKGROUND

1. Technical Field

The present disclosure relates to wellbore communication systems and particularly to electromagnetic systems and methods for generating and transmitting data signals between the surface of the earth and a bottom hole assembly.

2. Background Art

Wells are generally drilled into the ground to recover natural deposits of hydrocarbons and other desirable materials trapped in geological formations in the Earth's crust. A well is typically drilled using a drill bit attached to the lower end of a drill string. The well is drilled so that it penetrates the subsurface formations containing the trapped materials and the materials can be recovered.

At the bottom end of the drill string is a "bottom hole assembly" ("BHA"). The BHA includes the drill bit along with sensors, control mechanisms, and the required circuitry. A typical BHA includes sensors that measure various properties of the formation and of the fluid that is contained in the formation. A BHA may also include sensors that measure the BHA's orientation and position.

The drilling operations may be controlled by an operator at the surface or operators at a remote operations support center. The drill string is rotated at a desired rate by a rotary table, or top drive, at the surface, and the operator controls the weight-on-bit and other operating parameters of the drilling process.

Another aspect of drilling and well control relates to the drilling fluid, called "mud". The mud is a fluid that is pumped from the surface to the drill bit by way of the drill string. The mud serves to cool and lubricate the drill bit, and it carries the drill cuttings back to the surface. The density of the mud is carefully controlled to maintain the hydrostatic pressure in the borehole at desired levels.

In order for the operator to be aware of the measurements made by the sensors in the BHA, and for the operator to be able to control the direction of the drill bit, communication between the operator at the surface and the BHA is necessary. A "downlink" is a communication from the surface to the BHA. Based on the data collected by the sensors in the BHA, an operator may desire to send a command to the BHA. A common command is an instruction for the BHA to change the direction of drilling.

Likewise, an "uplink" is a communication from the BHA to the surface. An uplink is typically a transmission of the data collected by the sensors in the BHA. For example, it is often important for an operator to know the BHA orientation. Thus, the orientation data collected by sensors in the BHA is often transmitted to the surface. Uplink communications are also used to confirm that a downlink command was correctly understood and executed.

One common method of communication is called "mud pulse telemetry." Mud pulse telemetry is a method of sending signals, either downlinks or uplinks, by creating pressure and/or flow rate pulses in the mud. These pulses may be detected by sensors at the receiving location. For example, in a downlink operation, a change in the pressure or the flow rate of the mud being pumped down the drill string may be detected by a sensor in the BHA. The pattern of the pulses, such as the frequency, the phase, and the amplitude, may be detected by the sensors and interpreted so that the command may be understood by the BHA.

Mud pulse telemetry systems are typically classified as one of two species depending upon the type of pressure pulse generator used, although "hybrid" systems have been disclosed. The first species uses a valving "poppet" system to generate a series of either positive or negative, and essentially discrete, pressure pulses which are digital representations of transmitted data. The second species, an example of which is disclosed in U.S. Pat. No. 3,309,656, comprises a rotary valve or "mud siren" pressure pulse generator which repeatedly interrupts the flow of the drilling fluid, and thus causes varying pressure waves to be generated in the drilling fluid at a carrier frequency that is proportional to the rate of interruption. Downhole sensor response data is transmitted to the surface of the earth by modulating the acoustic carrier frequency. A related design is that of the oscillating valve, as disclosed in U.S. Pat. No. 6,626,253, wherein the rotor oscillates relative to the stator, changing directions every 180 degrees, repeatedly interrupting the flow of the drilling fluid and causing varying pressure waves to be generated.

With reference to FIG. 1, a drilling rig 10 includes a drive mechanism 12 to provide a driving torque to a drill string 14. The lower end of the drill string 14 extends into a wellbore 30 and carries a drill bit 16 to drill an underground formation 18. During drilling operations, drilling mud 20 is drawn from a mud pit 22 on the earth's surface 29 via one or more pumps 24 (e.g., reciprocating pumps). The drilling mud 20 is circulated through a mud line 26 down through the drill string 14, through the drill bit 16, and back to the surface 29 via an annulus 28 between the drill string 14 and the wall of the wellbore 30. Upon reaching the surface 29, the drilling mud 20 is discharged through a line 32 into the mud pit 22 so that rock and/or other well debris carried in the mud can settle to the bottom of the mud pit 22 before the drilling mud 20 is recirculated.

Still referring to FIG. 1, one known wellbore telemetry system 100 is depicted including a downhole measurement while drilling (MWD) tool 34 incorporated in the drill string 14 near the drill bit 16 for the acquisition and transmission of downhole data or information. The MWD tool 34 includes an electronic sensor package 36 and a mudflow wellbore telemetry device 38. The mudflow telemetry device 38 can selectively block the passage of the mud 20 through the drill string 14 to cause pressure changes in the mud line 26. In other words, the wellbore telemetry device 38 can be used to modulate the pressure in the mud 20 to transmit data from the sensor package 36 to the surface 29. Modulated changes in pressure are detected by a pressure transducer 40 and a pump piston sensor 42, both of which are coupled to a surface system processor (not shown). The surface system processor interprets the modulated changes in pressure to reconstruct the data collected and sent by the sensor package 36. The modulation and demodulation of a pressure wave are described in detail in commonly assigned U.S. Pat. No. 5,375,098, which is incorporated by reference herein in its entirety.

The surface system processor may be implemented using any desired combination of hardware and/or software. For example, a personal computer platform, workstation platform, etc. may store on a computer readable medium (e.g., a magnetic or optical hard disk, random access memory, etc.) and execute one or more software routines, programs, machine readable code or instructions, etc. to perform the operations described herein. Additionally or alternatively, the surface system processor may use dedicated hardware or logic such as, for example, application specific integrated circuits, configured programmable logic controllers, discrete logic, analog circuitry, passive electrical components, etc. to perform the functions or operations described herein.

Still further, while the surface system processor can be positioned relatively proximate to the drilling rig (i.e., substantially co-located with the drilling rig), some part of or the entire surface system processor may alternatively be located relatively remotely from the rig. For example, the surface system processor may be operationally and/or communicatively coupled to the wellbore telemetry component 18 via any combination of one or more wireless or hardwired communication links (not shown). Such communication links may include communications via a packet switched network (e.g., the Internet), hardwired telephone lines, cellular communication links and/or other radio frequency based communication links, etc. using any desired communication protocol.

Additionally one or more of the components of the BHA may include one or more processors or processing units (e.g., a microprocessor, an application specific integrated circuit, etc.) to manipulate and/or analyze data collected by the components at a downhole location rather than at the surface.

Electromagnetic MWD telemetry uses an electric dipole (voltage applied across an insulated gap) as a downhole source. The received signal at the surface is the voltage sensed between two or more ground electrodes. That is, receivers for electromagnetic MWD telemetry systems generally comprise grounding stakes, and the signal is the voltage measured at the stake with reference to the rig structure. Low frequency signals are used to overcome attenuation. The system is totally reversible: by forcing a current across the two surface electrodes, a corresponding voltage can be sensed downhole across the insulating gap. This telemetry system does not require mud flow for telemetry operations and is therefore less intrusive to rig operations. Examples of electromagnetic telemetry systems using electrodes separated by an insulated gap is found in U.S. Pat. No. 5,642,051 and U.S. Pat. No. 7,080,699.

This prior art method is limited, however, to land use because offshore the signal is short circuited by the salt water. Limitations of electromagnetic MWD are related to depth, formation resistivity, and the presence of insulating layers like anhydrite streaks. Signal reception is difficult and pick-up (receiver) electrodes have to be buried sufficiently deep to avoid the shorting effect of the salt water and the low resistivity of shallow sediments. For at least those reasons, electromagnetic MWD telemetry is seldom used offshore.

Magnetometers (search coils) have been proposed to sense the magnetic field induced by the telemetry currents. However, this has not been successful to the point of commercial application. Experiments have been performed using subsea magnetometers, but the results have not been very successful.

SUMMARY

The present disclosure relates to a telemetry system. The telemetry system includes a first downhole device capable of transmitting and/or receiving a signal disposed in a first wellbore, an electronics control system located at or near the top of the first wellbore, a cable disposed in the first wellbore that provides signal communication between the first downhole device and the electronics control system, and a second downhole device capable of transmitting and/or receiving a signal disposed in a second wellbore. The signal is passed through the cable between the first downhole device and the electronics control system. From there, the signal may be re-transmitted to a desired location.

Other aspects and advantages of the invention will become apparent from the following description and the attached claims.

BRIEF DESCRIPTION OF THE FIGURES

So that the above recited features and advantages of the present disclosure can be understood in detail, a more particular description, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

Figure 1:
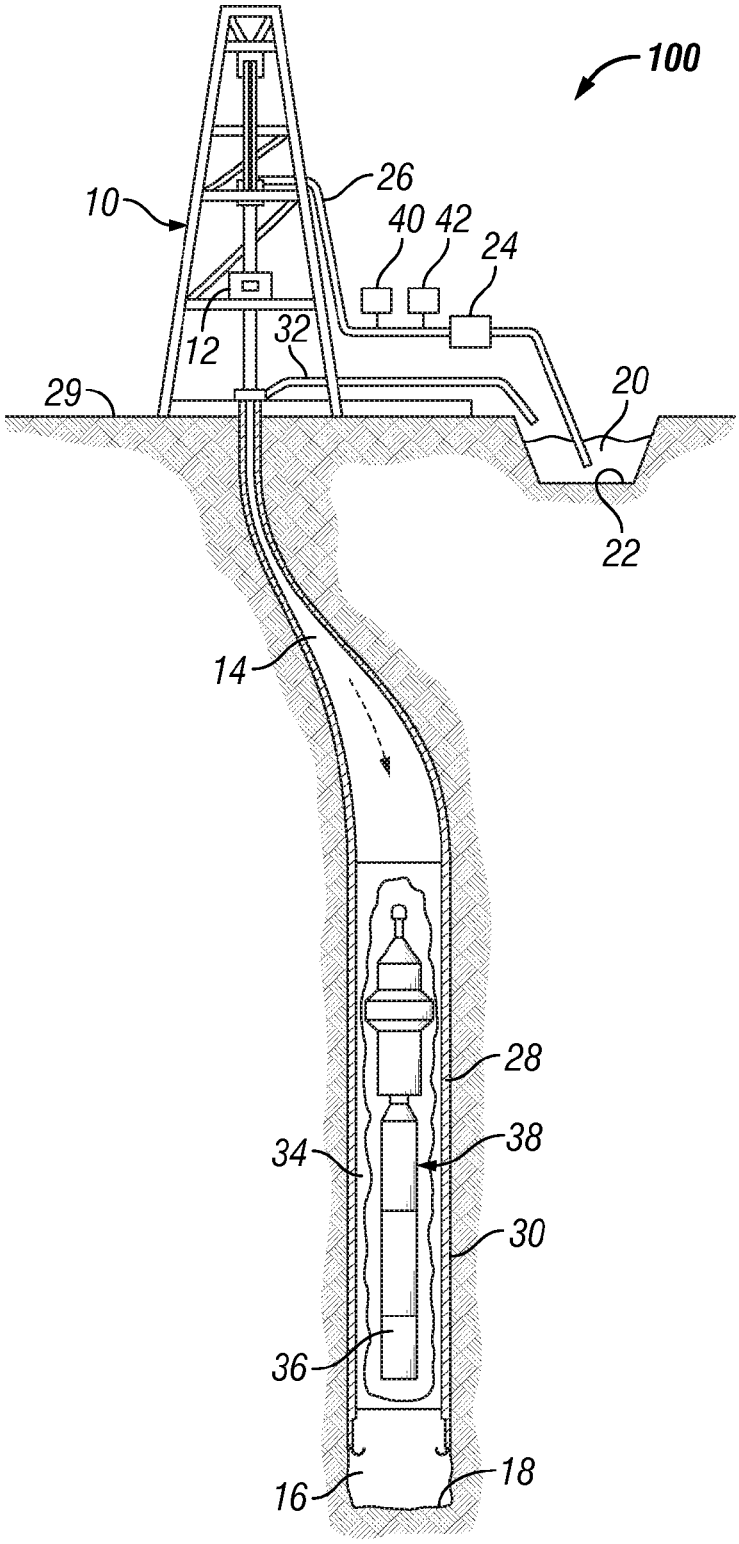
FIG. 1 (Prior Art)
FIG. 1 is a schematic view, partially in cross-section, of a known measurement while drilling tool and wellbore telemetry device connected to a drill string and deployed from a rig into a wellbore.

It is to be understood that the drawings are to be used for the purpose of illustration only, and not as a definition of the metes and bounds of the invention, the scope of which is to be determined only by the scope of the appended claims.

DETAILED DESCRIPTION

Specific embodiments of the invention will now be described with reference to the figures. Like elements in the various figures will be referenced with like numbers for consistency. In the following description, numerous details are set forth to provide an understanding of the present disclosure. However, it will be understood by those skilled in the art that the present invention may be practiced without these details and that numerous variations or modifications from the described embodiments are possible.

The following terms have a specialized meaning in this disclosure. While many are consistent with the meanings that would be attributed to them by a person having ordinary skill in the art, the meanings are also specified here.

In this disclosure, "fluid communication" is intended to mean connected in such a way that a fluid in one of the components may travel to the other. For example, a bypass line may be in fluid communication with a standpipe by connecting the bypass line directly to the standpipe. "Fluid communication" may also include situations where there is another component disposed between the components that are in fluid communication. For example, a valve, a hose, or some other piece of equipment used in the production of oil and gas may be disposed between the standpipe and the bypass line. The standpipe and the bypass line may still be in fluid communication so long as fluid may pass from one, through the interposing component or components, to the other.

A "drilling system" typically includes a drill string, a BHA with sensors, and a drill bit located at the bottom of the BHA. Mud that flows to the drilling system must return through the annulus between the drill string and the borehole wall. In the art, a "drilling system" may be known to include the rig, the rotary table, and other drilling equipment, but in this disclosure it is intended to refer to those components that come into contact with the drilling fluid.

"Signal communication" means the ability or capacity to transmit or receive a signal between two or more devices such as transmitters, receivers, transceivers, or fiber optic devices. The signal may be carried in or on, for example, an electrical cable, a fiber optic cable, or it may pass wirelessly between the devices. Signal communication further includes data and/or power transmission.

Most offshore fields are developed by drilling multiple deviated and horizontal drainage wells. Several tens, perhaps as many as a hundred, drainage wells are drilled from a single surface location. Prior to developing the field, however, one or more mostly vertical appraisal wells are typically drilled to evaluate the subsurface formations. After a comprehensive logging and testing program, appraisal wells are often plugged and abandoned (P&A).

Figure 2:
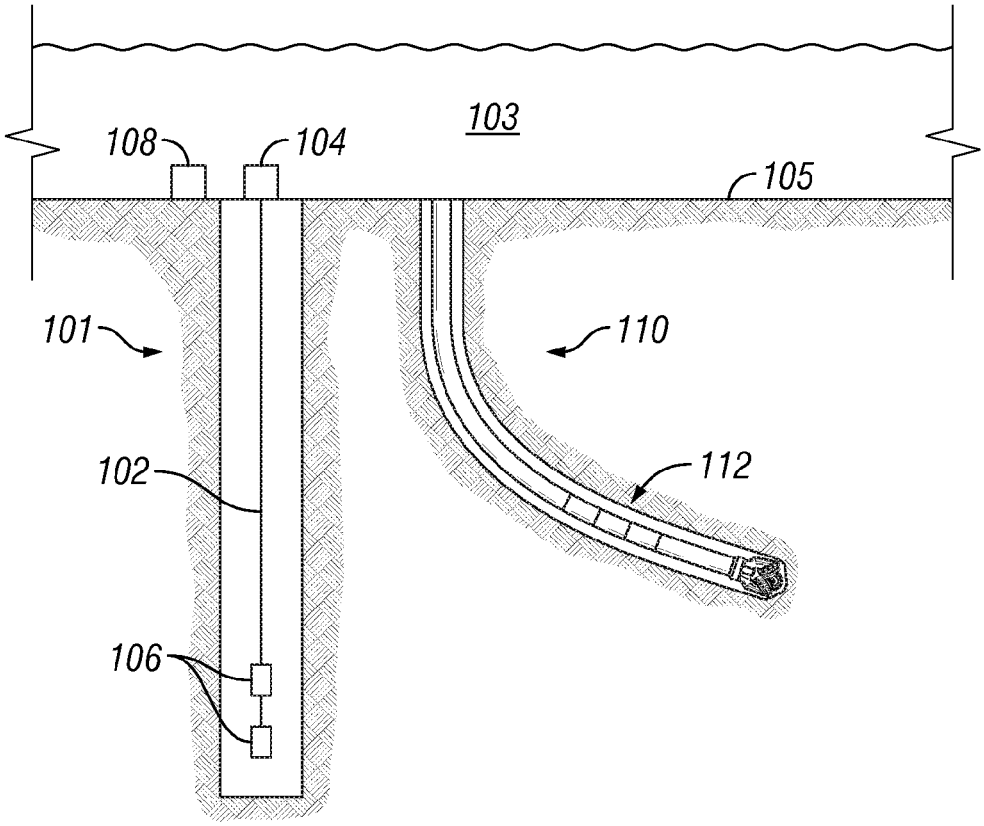
FIG. 2 is a schematic drawing of a telemetry system, constructed in accordance with the present disclosure.

FIG. 2 shows a field having a representative appraisal well 101 below sea water 103 and seafloor 105. While only one appraisal well 101 is shown, others may be present. A cable 102 extends from a subsea wellhead 104 down some desired distance into appraisal well 101. Cable 102 may be, for example, an electrical cable or a fiber optic cable. Distributed along and/or at the lower end of cable 102 are receivers 106. A single receiver 106 may be used, but preferably an array of receivers 106 is used. Receivers 106 may be, for example, electrodes or magnetometers (e.g., fluxgate magnetometers or search coils). Receivers 106 may also be fiber optic devices. The exhaustive logging program performed on the appraisal well can provide information used to optimize placement of receivers 106. For example, if a highly resistive layer is identified, receivers may be placed above and below that layer. Cable 102 and receivers 106 can be permanently installed, if desired, during the P&A operations. In that manner, appraisal well 101 may be permanently instrumented.

It should be noted that, while the description above and what follows speaks mostly in terms of downhole receivers used in an uplink mode, by reciprocity the receivers can be replaced by transmitters, and vice versa, and the tool may be used in a downlink mode. That is, in uplink mode, for example, information from an ancillary tool in another wellbore may be transmitted to the receivers in the appraisal well, and that information is communicated to the surface or seafloor between devices that are in signal communication with one another (e.g., using the cable or perhaps wireless telemetry). However, the invention can equally be used in downlink mode. For example, instructions and/or data can be sent from the surface or seafloor to a downhole device that is in signal communication with an uphole device. That downhole device could then convey the command(s) and/or data to an ancillary tool in another wellbore. It is to be understood that the present description may speak in terms of receivers, and the examples may illustrate an uplink mode, but that is for ease of description only and the invention is intended to encompass the use of transmitters, receivers, and/or transceivers configured and used in a downlink mode as well.

As indicated above, downhole receivers 106 are connected to wellhead 104 by a cable 102 that is deployed as part of the P&A program. Cable 102 terminates at the subsea wellhead 104 where electronics and power modules 108 are installed. For example, a battery-powered electronic control system 108 may be installed at the sea floor 105 on or near wellhead 104. Signal from the downhole receivers 106 are sensed, amplified, and decoded, and subsequently transmitted to a surface location using, for example, an umbilical or standard acoustic telemetry. Standard acoustic telemetry is well suited for underwater applications. Acoustic telemetry uses acoustic energy to convey a signal. The acoustic energy can pass, for example, through drill pipe or casing, or through a fluid such as the water above the seafloor. Alternatively, communication to a surface location can be achieved using an umbilical. Examples of using acoustic telemetry or an umbilical as a communication link to the surface are described in U.S. Pat. No. 7,261,162. Standard existing techniques for subsea instrumentation may be used for maintenance or battery servicing.

Figure 3:
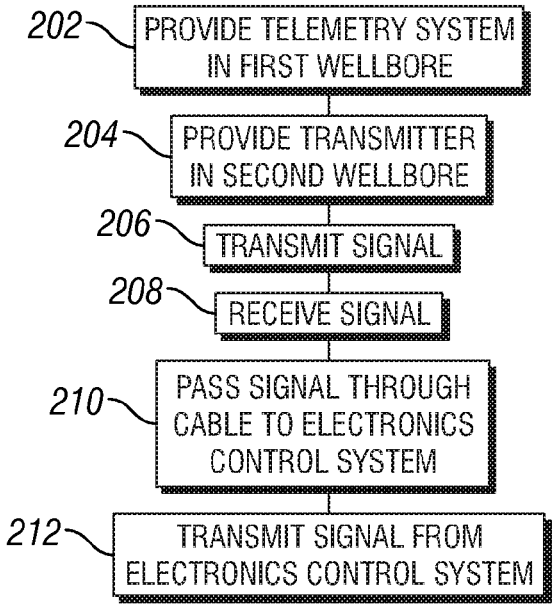
FIG. 3 is a flowchart showing one embodiment of the method described in the present disclosure.

In operation, when drilling a drainage well 110, an electromagnetic telemetry tool 112 may be deployed as part of the BHA. The transmitted signal from electromagnetic telemetry tool 112 is detected by receivers 106 in appraisal well 101, relayed by cable 102 to wellhead 104, and re-transmitted to a surface location. The surface location can be any desired location; the term is intended to encompass any location remote from the electronic control system 108. This process is illustrated in the flowchart of FIG. 3 as steps 202, 204, 206, 208, 210, and 212.

The standard telemetry used to re-broadcast the MWD telemetry signals from the seabed to the surface may also be used for downlinking operations. In the case where downlinking is needed, a command sent to electronics control system 108 causes electronic control system 108 to send power downhole and a current is injected, for example, between one of the electrodes 106 and an electric ground (e.g., casing) or across two electrodes 106. For example, in an uncased hole, two or more spaced electrodes 106 can be used. In a partially cased well, one electrode placed below the casing and the casing itself will serve. In a cased well, an insulated gap may be built into the casing string and the separated portions of casing can be used. The resulting electric field in the formation is sensed by electromagnetic telemetry tool 112 and the command passed on to the MWD tool.

If desired, the system could operate in a full duplex mode, for instance, by operating at different frequencies for transmitting and receiving. Data or commands may be encoded using, for example, frequency, phase, or amplitude modulation, or a combination of those. That is, the signal can be modulated to encode data using, for example, methods known in digital communications. The uplink and downlink modes could be operated simultaneously or sequentially.

The investment corresponding to the installation of the permanent receivers 106 may be amortized over the entire development. This technique would be adaptable to high pressure, high temperature (HPHT) fields in that the electromagnetic telemetry system is much simpler than a mud pulse telemetry system, and therefore more likely to be reliable in a HPHT application.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded. While the invention has been described with respect to a limited number of embodiments, those skilled in the art, having benefit of this disclosure, will appreciate that other embodiments can be envisioned that do not depart from the scope of the invention as disclosed herein.

What is claimed is:

1. A telemetry system, comprising:

a first downhole device disposed in a first wellbore, the first downhole device being able to transmit and/or receive signals;

an electronics control system located at or near the top of the first wellbore;

a cable disposed in the first wellbore that provides for signal communication between the first downhole device and the electronics control system; and a second downhole device disposed in a second wellbore, the second downhole device being able to transmit and/or receive signals.

2. The telemetry system of claim 1, wherein the first wellbore is an appraisal well.

3. The telemetry system of claim 1, further comprising one or more additional downhole devices capable of transmitting and/or receiving signals, variously spaced and disposed in the first wellbore and in signal communication with the electronics control system.

4. The telemetry system of claim 3, wherein the additional downhole devices comprise electrodes, magnetometers, fiber optic devices, or a combination of those.

5. The telemetry system of claim 1, wherein the electronics control system includes at least one of an electromagnetic transmitter, an acoustic transmitter, an electromagnetic receiver, an acoustic receiver, and a fiber optic device.

6. The telemetry system of claim 1, wherein the first downhole device and the cable are permanently installed in the first wellbore.

7. The telemetry system of claim 1, wherein the second downhole device is on a while drilling tool.

8. The telemetry system of claim 1, further comprising a wellhead that interfaces the cable and the electronics control system.

9. The telemetry system of claim 8, wherein the electronics control system is located on or near the wellhead.

10. The telemetry system of claim 1, wherein the first wellbore is a subsea wellbore.

11. The telemetry system of claim 1, wherein the second wellbore is a drainage well.

12. The telemetry system of claim 1, wherein the electronics control system is in signal communication with a surface location.

13. The telemetry system of claim 11, further comprising an umbilical, an acoustic telemetry system, a wireless telemetry system, or a combination of those to provide the signal communication between the electronics control system and the surface location.

14. The telemetry system of claim 1, wherein the signal transmitted and received by the first and second downhole devices is electromagnetic.

15. A method to telemeter data, comprising:

providing a telemetry system comprising one or more downhole devices capable of transmitting and/or receiving signals disposed in a first wellbore; an electronics control system located at or near the top of the first wellbore; and a cable disposed in the first wellbore that provides for signal communication between the one or more downhole device disposed in the first well and the electronics control system;

providing one or more downhole devices capable of transmitting and/or receiving signals disposed in a second wellbore;

transmitting a signal from the one or more downhole devices in one of the wells;

receiving the signal with the one or more downhole devices in the other well;

passing the signal through the cable to the electronics control system; and transmitting the signal from the electronics control system to a desired location.

16. The method of claim 15, further comprising encoding information on the signal.

17. The method of claim 16, wherein the encoded information is drilling data and/or formation evaluation data.

18. The method of claim 17, further comprising making drilling decisions based on the drilling data and/or formation evaluation data.

19. The method of claim 15, wherein the transmitting a signal from the one or more downhole devices in one of the wells comprises passing a current through the cable and across an insulated gap into the formation.

20. The method of claim 15, wherein the signal comprises a first frequency to uplink information and a second frequency to downlink information.

21. The method of claim 20, wherein the uplink operation sand downlink operation are performed simultaneously.

22. The method of claim 20, wherein the uplink information and/or the downlink information includes instruction and/or data.

23. The method of claim 15, wherein the signal is modulated using frequency modulation, phase modulation, amplitude modulation, or a combination of those.

24. The method of claim 15, further comprising optimizing the placement of the one or more devices disposed in the first wellbore using existing logging data.

25. A method to telemeter data while drilling a drainage well, comprising:

providing a telemetry system comprising one or more downhole devices capable of receiving or transmitting a signal disposed in an appraisal well; an electronics control system located at or near the top of the appraisal well; and a cable disposed in the appraisal well that provides signal communication between the one or more downhole devices disposed in the appraisal well and the electronics control system;

providing a while drilling electromagnetic telemetry tool disposed in the drainage well;

transmitting and/or receiving the signal from or by the electromagnetic telemetry tool;

receiving and/or transmitting the signal with the one or more downhole devices disposed in the appraisal well;

passing the signal through the cable to the electronics control system; and transmitting the signal from the electronics control system to a desired location or receiving the signal from a desired location by the electronic control system.

26. The method of claim 25, wherein the one or more downhole devices and cable are permanently installed in the appraisal well.

* * * * *